US009194233B2

(12) United States Patent
Cochran

(10) Patent No.: US 9,194,233 B2
(45) Date of Patent: Nov. 24, 2015

(54) DISK TURBINE USING HEAT PIPES

(71) Applicant: William W. Cochran, Fort Collins, CO (US)

(72) Inventor: William W. Cochran, Fort Collins, CO (US)

( * ) Notice: Subject to any disclaimer, the term of this patent is extended or adjusted under 35 U.S.C. 154(b) by 66 days.

(21) Appl. No.: 14/180,213

(22) Filed: Feb. 13, 2014

(65) Prior Publication Data

US 2014/0271120 A1 Sep. 18, 2014

Related U.S. Application Data

(60) Provisional application No. 61/764,373, filed on Feb. 13, 2013.

(51) Int. Cl.

| | |
|---|---|
| ***F01D 1/00*** | (2006.01) |
| ***F01D 1/02*** | (2006.01) |
| ***F01D 5/08*** | (2006.01) |
| ***F01D 5/18*** | (2006.01) |
| ***F01K 7/16*** | (2006.01) |

(52) U.S. Cl.

CPC ..... *F01D 1/026* (2013.01); *F01D 5/088* (2013.01); *F01D 5/181* (2013.01); *F01D 5/185* (2013.01); *F01K 7/16* (2013.01); *F05D 2220/31* (2013.01); *F05D 2260/208* (2013.01)

(58) Field of Classification Search

CPC ..... F01D 1/34; F01D 1/36; F03B 5/00; F05D 2260/208

See application file for complete search history.

(56) References Cited

U.S. PATENT DOCUMENTS

| | | | |
|---|---|---|---|
| 514,169 | A | 2/1894 | Tesla |
| 1,061,206 | A | 5/1913 | Tesla |
| 3,024,596 | A | 3/1962 | Hatfield |
| RE28,742 | E | 3/1976 | Rafferty et al. |
| 4,218,177 | A | 8/1980 | Robel |
| 4,224,797 | A | 9/1980 | Kelly |
| 4,295,334 | A | 10/1981 | Johnson |
| 4,402,647 | A | 9/1983 | Effenberger |
| 4,493,615 | A | 1/1985 | Stangroom |
| 4,655,679 | A | 4/1987 | Giacomel |
| 5,470,197 | A | 11/1995 | Cafarelli |
| 5,534,118 | A | 7/1996 | McCutchen |
| 5,803,733 | A | 9/1998 | Trott et al. |
| 6,135,708 | A | 10/2000 | Conrad et al. |
| 6,164,404 | A | 12/2000 | Hinrichs |
| 6,174,127 | B1 | 1/2001 | Conrad et al. |
| 6,183,641 | B1 | 2/2001 | Conrad et al. |
| 6,224,325 | B1 | 5/2001 | Conrad et al. |
| 6,238,177 | B1 | 5/2001 | Conrad et al. |

(Continued)

FOREIGN PATENT DOCUMENTS

| | | |
|---|---|---|
| WO | 2004013491 | 2/2004 |
| WO | 2004033759 | 4/2004 |

(Continued)

OTHER PUBLICATIONS

Cao, Yiding. "Miniature High-Temperature Rotating Heat Pipes and Their Applications in Gas Turbine Cooling." Frontiers in Heat . Pipes (FHP) 1.2 (2010).*

*Primary Examiner* — Audrey K Bradley

(74) *Attorney, Agent, or Firm* — William W. Cochran; Cochran Freund & Young LLC

(57) ABSTRACT

Disclosed is a steam turbine that utilizes heat pipes to remove heat from the surfaces of the disks of the steam turbine to provide greater efficiency and longer operational service of the steam turbine.

2 Claims, 5 Drawing Sheets

(56) References Cited

U.S. PATENT DOCUMENTS

| | | | |
|---|---|---|---|
| 6,261,052 | B1 | 7/2001 | Conrad et al. |
| 6,328,527 | B1 | 12/2001 | Conrad et al. |
| 6,375,412 | B1 | 4/2002 | Dial |
| 6,446,597 | B1 | 9/2002 | McAlister |
| 6,503,067 | B2 | 1/2003 | Palumbo |
| 6,617,738 | B2 | 9/2003 | Dickinson |
| 6,666,024 | B1 | 12/2003 | Moskal |
| 6,672,539 | B1 | 1/2004 | Schoeneck |
| 6,682,077 | B1 | 1/2004 | Letourneau |
| 6,692,232 | B1 | 2/2004 | Letourneau |
| 6,726,443 | B2 | 4/2004 | Collins et al. |
| 6,779,964 | B2 | 8/2004 | Dial |
| 6,799,363 | B1 | 10/2004 | Dickinson |
| 6,973,792 | B2 | 12/2005 | Hicks |
| 7,062,900 | B1 | 6/2006 | Brun |
| 7,192,244 | B2 | 3/2007 | Grande, III et al. |
| 7,227,274 | B2 | 6/2007 | Berkson |
| 7,341,424 | B2 | 3/2008 | Dial |
| 7,382,072 | B2 | 6/2008 | Erfourth |
| 7,455,504 | B2 | 11/2008 | Hill et al. |
| 7,478,990 | B2 | 1/2009 | Wilson |
| 7,569,089 | B2 | 8/2009 | Avina |
| 7,695,242 | B2 | 4/2010 | Fuller |
| 7,808,118 | B2 | 10/2010 | Berkson |
| 7,824,149 | B2 | 11/2010 | Brewer |
| 7,842,121 | B2 | 11/2010 | Sanderson et al. |
| 7,909,013 | B2 | 3/2011 | Shkolnik et al. |
| 2002/0050719 | A1 | 5/2002 | Caddell et al. |
| 2002/0182054 | A1 | 12/2002 | Entrican, Jr. |
| 2003/0012985 | A1 | 1/2003 | McAlister |
| 2005/0172624 | A1 | 8/2005 | Holecek et al. |
| 2007/0013192 | A1 | 1/2007 | Berkson |
| 2007/0116554 | A1 | 5/2007 | Brewer |
| 2007/0151245 | A1 | 7/2007 | Coffey et al. |
| 2007/0278795 | A1 | 12/2007 | Berkson |
| 2008/0092542 | A1 | 4/2008 | Graham |
| 2008/0141973 | A1 | 6/2008 | Shkolnik et al. |
| 2009/0082906 | A1 | 3/2009 | Sanderson et al. |
| 2009/0145739 | A1 | 6/2009 | Cotten |
| 2009/0260361 | A1 | 10/2009 | Prueitt |
| 2010/0129193 | A1 | 5/2010 | Sherrer |
| 2010/0156111 | A1 | 6/2010 | Pesce et al. |
| 2011/0023485 | A1 | 2/2011 | Schubert |
| 2011/0027069 | A1 | 2/2011 | Couto et al. |
| 2011/0114057 | A1 | 5/2011 | Shkolnik et al. |
| 2011/0125391 | A1 | 5/2011 | McAlister |
| 2011/0265474 | A1 | 11/2011 | Schubert |
| 2012/0006023 | A1 | 1/2012 | Johnson et al. |
| 2012/0007368 | A1 | 1/2012 | Valente |

FOREIGN PATENT DOCUMENTS

| | | |
|---|---|---|
| WO | 2007011641 | 1/2007 |
| WO | 2008134868 | 11/2008 |
| WO | 2008150839 | 12/2008 |
| WO | 2008016979 | 3/2009 |
| WO | 2009029685 | 3/2009 |
| WO | 2009109020 | 9/2009 |
| WO | 2009129233 | 10/2009 |
| WO | 2009131477 | 10/2009 |
| WO | 2010003205 | 1/2010 |
| WO | 2010031162 | 3/2010 |
| WO | 2010104503 | 9/2010 |
| WO | 2010031162 | 11/2010 |
| WO | 2012004127 | 1/2012 |

* cited by examiner

DISK TURBINE USING HEAT PIPES

CROSS-REFERENCE TO RELATED APPLICATION

This application is based upon and claims the benefit of U.S. provisional application No. 61/764,373, entitled "Tesla Turbine Using Heat Pipes," filed Feb. 13, 2013, the entire disclosure of which is herein specifically incorporated by reference for all that it discloses and teaches.

BACKGROUND OF THE INVENTION

Nikola Tesla was an immigrant to the United States from France. Mr. Tesla was born in Smiljan (now Croatia) on Jul. 10, 1856, and lived in the United States until Jan. 7, 1943, when he died in Manhattan, N.Y. Nikola Tesla was a true genius. Nikola Tesla was responsible for the adoption by the United States, and subsequently the rest of the world, of an alternating current power system for supplying electrical power. Unlike many of the geniuses of the late $19^{th}$ and early $20^{th}$ centuries, Nikola Tesla was not a theoretician but was able to actually build and demonstrate many incredible devices. For example, it has been reported that Nikola Tesla built a power generator system that was able to create ball lightning on a consistent basis. Others have not been able to reproduce these experiments. These experiments are of great interest to magnetic containment nuclear fusion scientists. It is rumored that Nikola Tesla's writings with regard to these experiments, and other devices that he built, are still classified and held by the U.S. Government.

SUMMARY OF THE INVENTION

The present invention may comprise a steam turbine comprising: a plurality of disks that rotate on a hub, the disks being separated by a predetermined space; steam injectors that inject steam between pairs of the disks in the predetermined space between the disks; at least one heat pipe disposed in each of the disks that transfers heat from outer peripheral portions of the disks to the hub that is connected to the disks; cooling water that flows through the hub to remove the heat from the hub.

The present invention may further comprise a method of removing heat from disks in a steam turbine comprising: providing a plurality of disks that are spaced apart by a predetermined spacing; injecting steam between the disks in the predetermined spacing, so that the steam condenses on the surfaces of the disks; removing heat from the disks to a hub using heat pipes that are disposed in the disks.

The present invention may further comprise a solar energy device comprising: a plurality of disks that rotate on a hub, the disks separated by gaps having predetermined spacings; steam injectors that inject steam in the gaps; a thermal solar collector that generates a source of steam from solar radiation that is applied to the steam injectors.

The present invention may further comprise a method of generating electricity from solar energy comprising: generating steam from solar radiation in a solar collector; applying the steam to at least one steam injector; injecting the steam from the steam injector in gaps between a plurality of disks that rotate on a hub which are separated by a predetermined distance to form the gaps; using rotational mechanical energy from the hub to drive an electrical generator that produces the electricity.

DETAILED DESCRIPTION OF THE EMBODIMENTS

Figure 1:
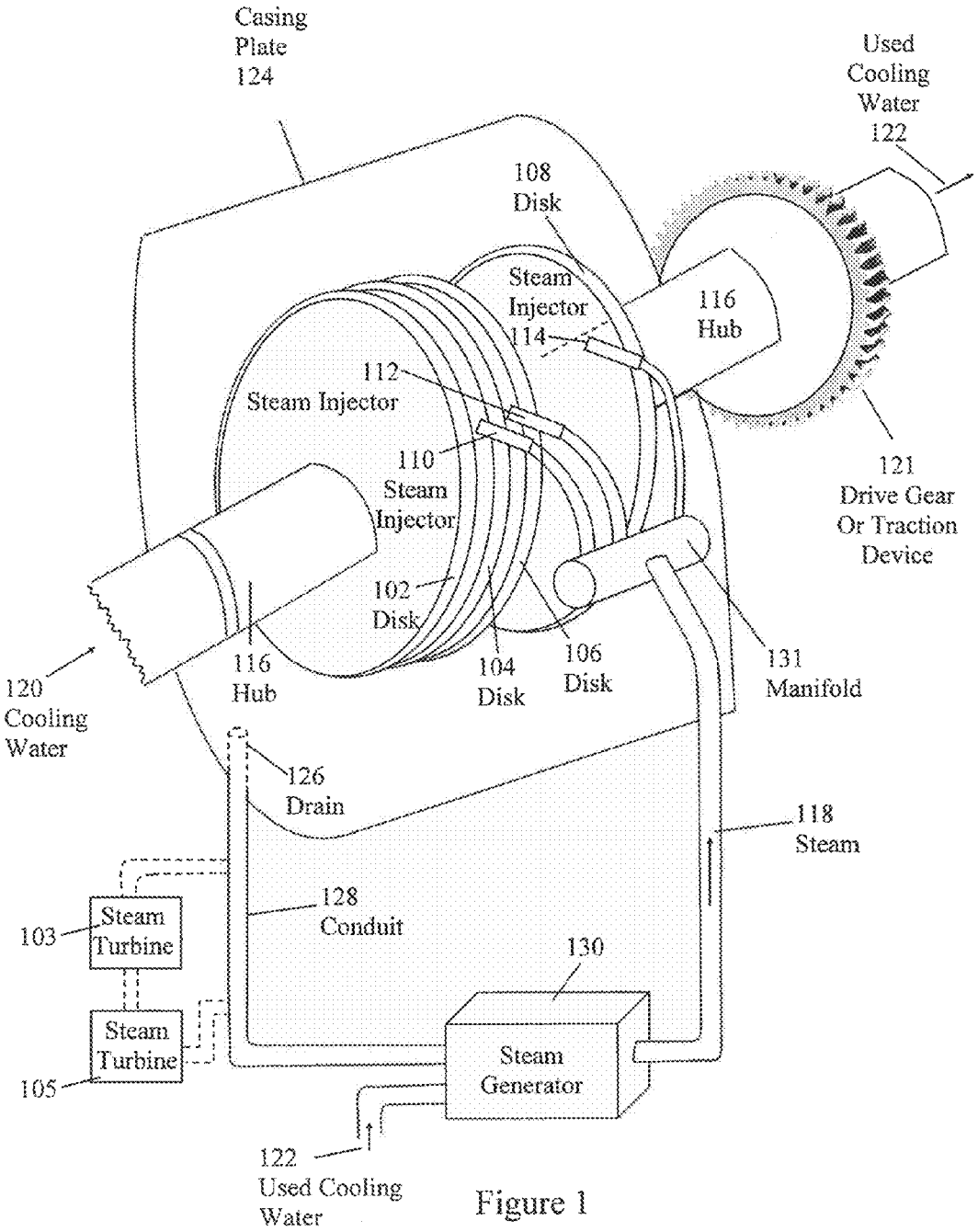
FIG. 1 is a schematic illustration of a steam turbine that utilizes heat pipes disposed in disks.

FIG. 1 is a schematic illustration of one embodiment of the present invention. The embodiment of FIG. 1 illustrates an embodiment of a steam turbine, similar to a Tesla steam turbine, that utilizes heat pipes disposed in disks 102, 104, 106, 108, respectively.

The steam turbine illustrated in FIG. 1 operates by the injection of steam 118 by steam injectors 110, 112, 114 between the disks 102, 104, 106, 108. The disks rotate around a hub 116 in response to the force generated by the kinetic energy of the water molecules of the steam 118 that are subjected to a boundary layer effect. The boundary layer is a layer in the immediate vicinity of a bounding surface where there are measurable effects of viscosity. Various other types of boundary layer effects are created when passing steam over a bounding surface, which may create viscous forces and convective inertia that are transferred to the bounding surface from the fluid passing over the bounding surface.

Aerodynamic boundary layers were first defined by Ludwig Prandtl, who created equations of fluid flow by dividing the flow field into two areas, i.e., one inside the boundary layer, dominated by viscosity, which creates the majority of drag experienced by the boundary body, and one outside the boundary layer, where viscosity can be neglected without significant effects on the solution. The majority of the heat transfer to and from the body that has the bounding surface also takes place within the boundary layer. Pressure drag increases with the boundary layer thickness. At the solid surface of the bounding layer, the fluid has zero velocity. However, moving away from the bounding layer, the velocity of flow asymptotically approaches the velocity of the stream. The boundary layer thickness, then, is the distance from the bounding surface, where there is zero velocity, to 99 percent of the free stream velocity. By cooling the bounding layer, the boundary layer is also cooled, which causes the boundary layer to have higher density, greater drag and greater boundary layer thickness. Accordingly, cooling the disks in a Tesla turbine increases the effectiveness of the Tesla turbine. The operation of the Tesla turbine over a period of time causes the disks in the Tesla turbine to increase in temperature, which decreases the thickness of the boundary layer and decreases the drag created by the boundary layer on the steam. As such, the longer the Tesla turbine is used, the less effective the turbine becomes. By cooling the disks, the effectiveness of the Tesla turbine over a period of time can be greatly increased.

The drag created on the water molecules of the steam creates a Coriolis effect that transfers the inertia of the water molecules in the steam to the disks of the turbine. The drag, again, is created by the boundary layer effect. The water molecules in the steam also tend to condense on the boundary surface of the disks 102, 108 and in the boundary layer, which transfers a large amount of energy to the boundary surface of the disks and the boundary layer because of the state change of the molecules from vapor to liquid. In other words, the steam contains water molecules that are injected across the surface of the disks 102-108 with a certain kinetic energy that is the result of the steam pressure of the steam 118 that is applied to steam injectors 110, 112, 114. When the water molecules of the steam 118 come into contact with the surfaces of disks 102-108, and the boundary layer, at least some of the water molecules condense, since the surface of the disks 102-108 are cooler than the steam. This causes a phase change of the water molecules of steam 118 from a gaseous phase to a liquid phase. This phase change causes energy, including the kinetic energy of the water molecules, to be transferred to the surfaces of disks 102-108 and the boundary layer. The condensation of the water molecules on the bounding surface of the disks and the phase change, heats the bounding surface of the disks and the boundary layer. The condensation of the water molecules on the surface of the disks also transfers the kinetic energy, as a result of disposition of the water molecules on the bounding surface of the disks and the boundary layer, which drives the disks 102-108 around the hub 116. Accordingly, the large amount of energy that is transferred to the bounding layer of the disks 102-108 and the boundary layer should be removed to maintain the drag of the boundary layer.

Hence, when water molecules condense on disks 102-108 and the boundary layer, heat energy from the steam water molecules is transferred to the surface of the disks 102-108 and the boundary layer very efficiently because of the phase transition from gas to liquid. Since the water molecules change phase from steam to liquid, there is a large amount of heat from the steam that is transferred to the surface of the disks 102-108. If the disks 102-108 do not have a large thermal mass, the temperature of the disks 102-108 and the boundary layer will rise. A rise in temperature of the boundary layer will decrease the density of the boundary layer. The thickness of the boundary layer will decrease and the drag of the boundary layer will decrease, causing the steam turbine 100 to be less efficient. Disks with a large thermal mass will heat up more slowly, which decreases the short term effects of heating.

On the other hand, it is desirable to use disks without a large thermal mass in the steam turbine, since energy is wasted in changing the momentum of disks to cause the disks to rotate when the disks have a large mass. Accordingly, the disks are constructed to be thin and have low mass, which also results in a low thermal mass.

Heat pipes were originally invented at the Los Alamos Scientific Laboratory (now known as the Los Alamos National Laboratory) in Los Alamos, N. Mex., in the 1950s. Heat pipes use thermal conductivity and phase transition to efficiently transfer heat. Heat pipes operate by evaporating a working fluid, such as water, at a hot end of the heat pipe and transmitting that heat in the form of water vapor to the cool end of the heat pipe, where the water vapor condenses. The use of water vapor, or other liquid vapors, allows the heat pipe to efficiently and quickly transfer heat along the heat pipe. The heat pipe is so efficient at the process of transferring heat that it has been considered to be the equivalent of a superconductor for transferring thermal heat. The working fluid of the heat pipe is selected in accordance with the operating temperature range of the heat pipe. For example, liquid helium can be used for extremely low temperature applications, while mercury may be used for very high temperature applications. Ammonia, alcohols and other fluids can be used for medium temperature applications. However, water is the most common fluid utilized for medium temperature applications.

A heat pipe consists of a sealed cavity in a material having relatively high thermal conductivity, such as most metals. A vacuum pump can be used to remove air from the heat pipe cavity and reduce the vapor pressure of a liquid (a working fluid) within the cavity. The working fluid may comprise water or various types of liquids, as set forth above.

The efficiency of the heat pipe is achieved by the phase transitions of the working fluid that occur inside the cavity of the heat pipe. The vacuum in the cavity of the heat pipe is adjusted so that the working fluid boils and turns to vapor at the temperature at the hot end of the heat pipe and condenses and returns to a liquid at the temperature at the cool end of the heat pipe. The phase change from liquid to gaseous state at the hot end of the heat pipe causes a substantial amount of energy to be absorbed by the vapor of the working fluid. Similarly, the condensation of the vapor of the working fluid at the cool end of the heat pipe causes a substantial amount of energy to be deposited at the cool end of the heat pipe because of the phase change from a vapor stage to a liquid stage. Accordingly, a large amount of energy can be efficiently and quickly transferred from the hot end to the cool end of the heat pipe. Adjustment of the vacuum in the cavity of the heat pipe allows the heat pipe to be finely adjusted to operate in certain temperature ranges.

Since steam is created at approximately 212 degrees Fahrenheit in one atmosphere pressure, condensation of the steam 118 on the surfaces of the disks 102-108 will occur below 212 degrees Fahrenheit. Of course, as the temperature of the surfaces of disks 102-108 drops lower than 212 degrees Fahrenheit, the condensation of steam increases. As such, the efficiency of the steam turbine 100 increases as the condensation of steam onto the surfaces of the disks 102-108 increases. For these reasons, the reduction of the temperature of the surfaces of the disks 102-108 assists in the operation and overall efficiency of the steam turbine 100. In that regard, degradation of the operation of the steam turbine 100 occurs when the temperature of the surfaces of the disk increases. In a steam turbine 100, the initial efficiency is high. As the turbine operates, heat is deposited in a very efficient manner onto the surface of the disks because of the phase transition of the steam from steam vapor molecules to liquid water molecules. This causes the heat from the steam to raise the temperature of the surfaces of the disks 102-108 and the boundary layer gases, causing the steam turbine to operate less efficiently. Also, as pointed out above, the disks have a low mass to accommodate easier rotation of the disks 102-108 and, accordingly, a low thermal mass, so the temperature of the disks rises faster than disks with larger mass and larger thermal mass. However, larger mass disks have higher momentum and the kinetic energy of the steam is not used as efficiently in higher mass disks during a start-up phase.

Because the temperature of the disks rises, as a result of the condensation of steam on the surface of the disks 102-108, the efficiency of the steam turbine 100 can be increased by cooling the disks, especially in the areas where the steam is injected onto the disks and where the steam condenses on the surface of the disks. This is accomplished by cooling the disks using heat pipes that run between the peripheral portions of disks 102-108 and hub 116, which is cooled by cooling water 120. This is explained in more detail with respect to FIGS. 2 and 3.

Referring again to FIG. 1, a plurality of disks 102-108 are mounted on hub 116, so that the disks 102-108 can rotate in response to being driven by steam injected across the disks by steam injectors 110, 112, 114. As illustrated in FIG. 1, the disks 102-108 are thin disks with low mass that are spaced apart by a selected spacing to form a tight configuration. The spacing between the disks 102-108 is sufficient to allow steam to be injected between each pair of disks through nozzles, which allows water molecules of the steam to condense on the surfaces of the disks 102-108. A manifold 131 is provided which allows the pressure of the steam 118, from steam generator 130, to equalize between each of the steam injectors 110, 112, 114. In this manner, a substantially equal amount of steam at substantially the same pressure is applied to each of the steam injectors 110, 112, 114. The stem injectors 110-114 include a nozzle, such as nozzle 111 (FIG. 2), that is preferably made from a hardened steel to prevent deterioration of the nozzle 111 as a result of application of the steam. The size of the opening in the nozzle 111 can be used to control the size and velocity of the steam that is injected between the pairs of disks 102-108. The nozzles on each of the steam injectors 110-114 may be made identically, so that the uniform pressure of the steam from the manifold 131 is uniformly applied through the plurality of nozzles in the spaces between each of the pairs of disks 102-108. The hub 116 is mounted on bearings (not shown) that allow the hub 116, which is connected to the disks 102-108, to rotate. A drive gear 121 is connected to the hub 116 to allow rotational mechanical energy to be transferred from the steam turbine 100, illustrated in FIG. 1, to an external device. Cooling water 120 passes through the hub 116, cools the disks 102-108, and passes out through the hub, as used cooling water 122. A casing plate 124 guides the steam around the peripheral portion of disks 102-108 and collects the condensed droplets that are ejected from the disks 102-108, so that the condensed steam vapor flows, as a source of water and some stream vapor, to the drain 126. The condensed steam vapor and steam flow through the drain 126 to conduit 128 and is re-injected into the steam generator 130. The condensed steam vapor has a high temperature, so that the steam generator 130 adds only an incremental amount of energy to the condensed steam vapor to generate additional steam 118. The casing plate 124 can surround the disks 102-108 to assist in entraining the steam 118 within the steam turbine 100, to further improve efficiency. Also, additional steam turbines, such as steam turbines 103-105, can be connected at the output of casing plate 124. Steam that is not condensed on the disks 102-108 can be used in additional steam turbines 103, 105 to create greater efficiencies.

Figure 2:
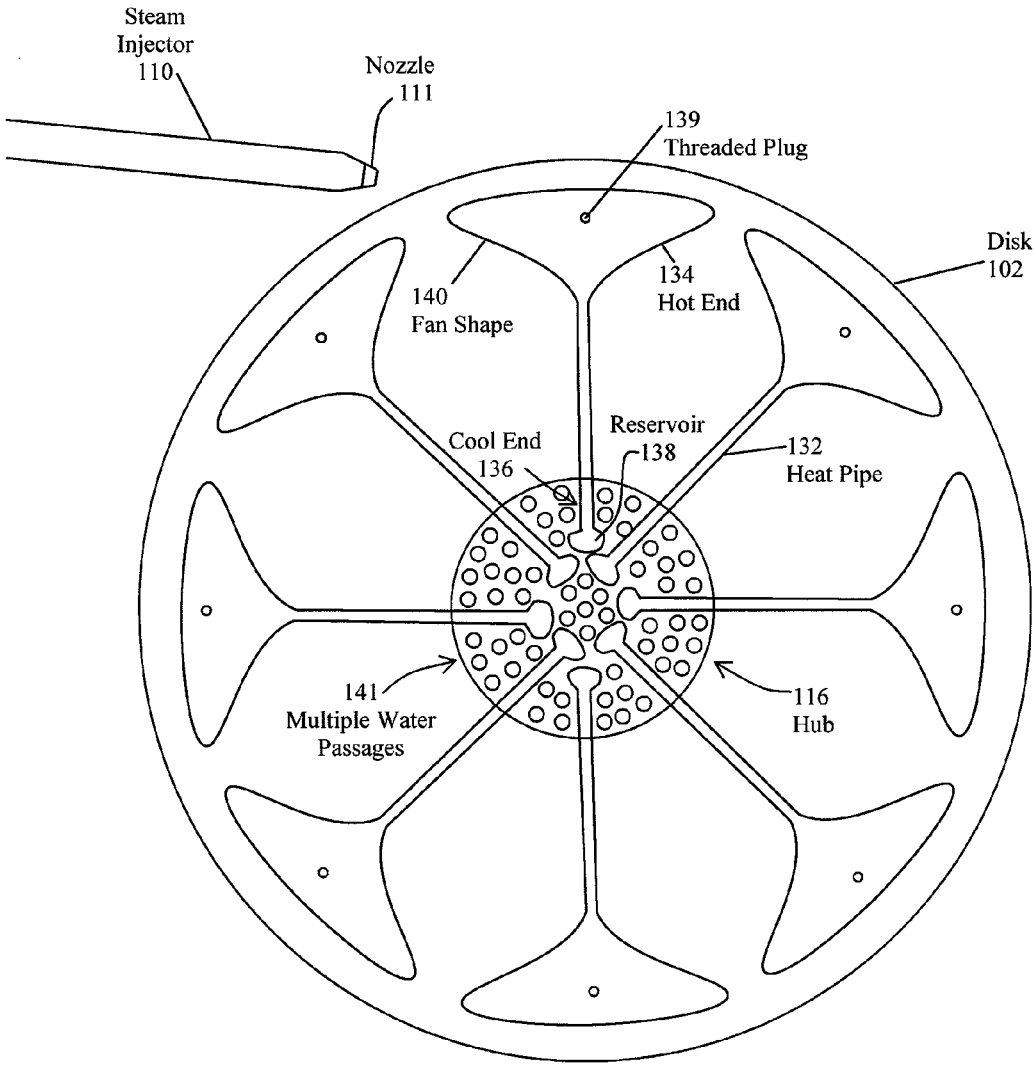
FIG. 2 is a schematic illustration of a cross-section of a disk having heat pipes.

FIG. 2 illustrates one embodiment of a disk, such as disk 102, that utilizes the heat pipe 132 to cool the peripheral surfaces of the disk 102. As illustrated in FIG. 2, a plurality of heat pipes, such as heat pipe 132, are disposed in the disk 102. FIG. 2 illustrates one example of a shape for the heat pipe 132 that achieves cooling of the peripheral areas of the disk 102. As shown in FIG. 2, the heat pipe 132 has a fan shape 140 at the hot end 134. As indicated above, the peripheral areas around the hot end 134 are the areas of the disk 102 that absorb heat from the steam injected between the disk by the steam injector 110 having a nozzle 111. As disclosed above, the steam 118 condenses on the surface of the disk 102, which causes the disk 102 to absorb the kinetic energy of the steam, but also causes the disk 102 to absorb a substantial amount of the heat of the steam because of the phase transition of the water molecules of the steam to a liquid. This causes the peripheral areas of the disk 102 to increase in temperature. The fan-shaped configuration of the heat pipe 132 allows large surface areas of the heat pipe 132 to transfer heat to the hub 116.

As also illustrated in FIG. 2, the heat pipe 132 has a reservoir 138, which is formed in the hub 116. In addition, there are a plurality of water passages formed in the hub 116, which the cooling water 120 passes through to cool the hub 116. The water passages 141 allow the cooling water 120 to pass through the hub 116 and cool the thermally conducted material of the hub 116, so that the cool end 136 of the heat pipe, as well as the reservoir 138 of the heat pipe 132, is cool. There are multiple water passages 141 in the hub 116 to increase the surface area that the cooling water 120 contacts the thermally conductive material of the hub 116. Various types of metals can be used as the thermally conductive material, since most metals have high thermal conductivity. The purpose of the reservoir 138 is to increase the surface area of the heat pipe in the hub 116, and to provide an area that is sufficiently large to accumulate the condensed working fluid of the heat pipe 132. In this manner, a sufficient amount of working fluid can be provided to cool the large fan-shaped area 140 of the heat pipe 132. Of course, the various sizes illustrated in FIG. 2 are not necessarily to scale, and the size of the reservoir, as well as the size and shape of the heat pipe 132, can be varied to achieve the proper transfer of heat from the hot end 134 to the cool end 136 of the heat pipe 132.

As indicated above, the heat pipe 132 can be finely tuned by adjusting the pressure, i.e., vacuum, within the cavity of the heat pipe. The vapor pressure of the working fluid is a factor in determining the vacuum that is drawn on the cavity of the heat pipe. Additionally, the operating temperature on peripheral portions of disk 102 is another factor in calculating the amount of vacuum within the heat pipe. In order for the heat pipe to operate properly, the working fluid of the heat pipe should boil, or vaporize, at the hot end 134 of heat pipe 132 during normal operating temperature of the disk 102, so that a vapor is created in the heat pipe cavity. The vapor of the working fluid migrates from the hot end 134 to the cool end 136 of the heat pipe, to transfer heat from the hot end 134 to the cool end 136, where the heat can be removed by the cooling water 120 flowing through the water passages 141. When the working fluid condenses at the cool end 136 of the heat pipe 132, the centrifugal force created by the rotation of the disk 102 causes the condensed working fluid to flow from the cool end 136 to the hot end 134. The liquid working fluid then boils at the hot end 134, and the process repeats.

Not only do the heat pipes, such as heat pipe 132, cause the disks to condense the steam vapor that is injected between disks 102-108 by lowering the temperature of the disks 102-108, the heat pipes also cool the disks sufficiently to prevent warping of the disks. Warping of the disks has been a problem in the operation of Tesla turbines. Again, the disks become very hot because a large amount of energy is transferred to the surface of the disks during the condensation of the steam vapor on the disk surface and in the boundary layer. At the time of the development of the Tesla turbine in 1911 by Nikola Tesla, material science and metallurgy was not sufficiently advanced to prevent the turbine disks from moving and warping during operation. Some applications now use carbon fiber disks to overcome the warping problem. However, there are significant problems associated with use of carbon fiber disks. Problems such as sheer losses and flow restrictions are overcome by embodiments of the present invention by cooling of the disks so that large diameter disks can be used, without warping and multiple thin disks can be used in high temperature enclosures. Sheer losses are also minimized by reducing the temperature of the disks. A continuously variable transmission (not shown) can be connected to allow the rotational speed at the output of the continuously variable transmission to be adjusted to drive an alternator at a predetermined desirable speed. Such devices are disclosed in U.S. Publication No. 2012/0165151 and U.S. patent application Ser. No. 13/354,320.

The steam generator 130 may comprise any type of steam generator, including passive, semi-passive, or active solar thermal collectors that heat a fluid, such as water, or other fluid, to temperatures sufficiently high to create steam. These solar collectors may use parabolic reflectors that move with the angle of the sun, or may be stationary. A focused sun beam can also be used. Fossil fuel fired steam generators can be used, as well as nuclear fired steam generators. These generators can be used alone, or in combination with solar collectors to create a hybrid system. The steam turbine 100 may be coupled via drive gear 121 to electrical generators to create electricity, or may drive mechanical systems. The extremely high efficiency of the steam turbine allows the conversion from the kinetic energy of the steam to a rotational mechanical energy that can be used for virtually any desired purpose. In this manner, both renewable and non-renewable energy sources can effectively and efficiently generate mechanical and electrical energy. Traction drives may also be used in place of drive gear 121 if high rotational speeds are created by steam turbine 100.

The somewhat elaborate shapes illustrated in FIG. 2, can be achieved by forming the disk 102 in two separate halves and then joining the halves together. The halves of the disk can be molded or machined to create the desired shape of the heat pipe cavities. In addition, portions of the hub 116 can be molded or machined as part of the disk 102, so that the structure illustrated in FIGS. 1 and 3 can be assembled by connecting the portions of the hub 116. The various openings illustrated in the hub 116, in that manner, can be formed with relative ease during the molding or machining process. In this manner, any number of desired disks can be assembled to create the steam turbine 100.

To achieve the proper vacuum within the heat pipe, and to place a working fluid within the heat pipe, a threaded opening and a threaded plug 139 can be formed in the outer periphery of the disk 102 to allow access to the heat pipe cavity. The heat pipe 132, illustrated in FIG. 2, may have a very flat and wide heat pipe cavity in the fan-shaped portion 140, rather than the rounded shape of many heat pipes. However, the shape of the cavity does not detract from the function of the heat pipe, as long as a sufficient amount of working fluid is provided within the heat pipe 132, so that the working fluid can be dispensed along the surface of the fan-shaped portion 140 prior to being vaporized. Accordingly, the reservoir 138, at the hot end 134 of the heat pipe 132, must be sufficiently large to hold a sufficient amount of working fluid.

Figure 3:
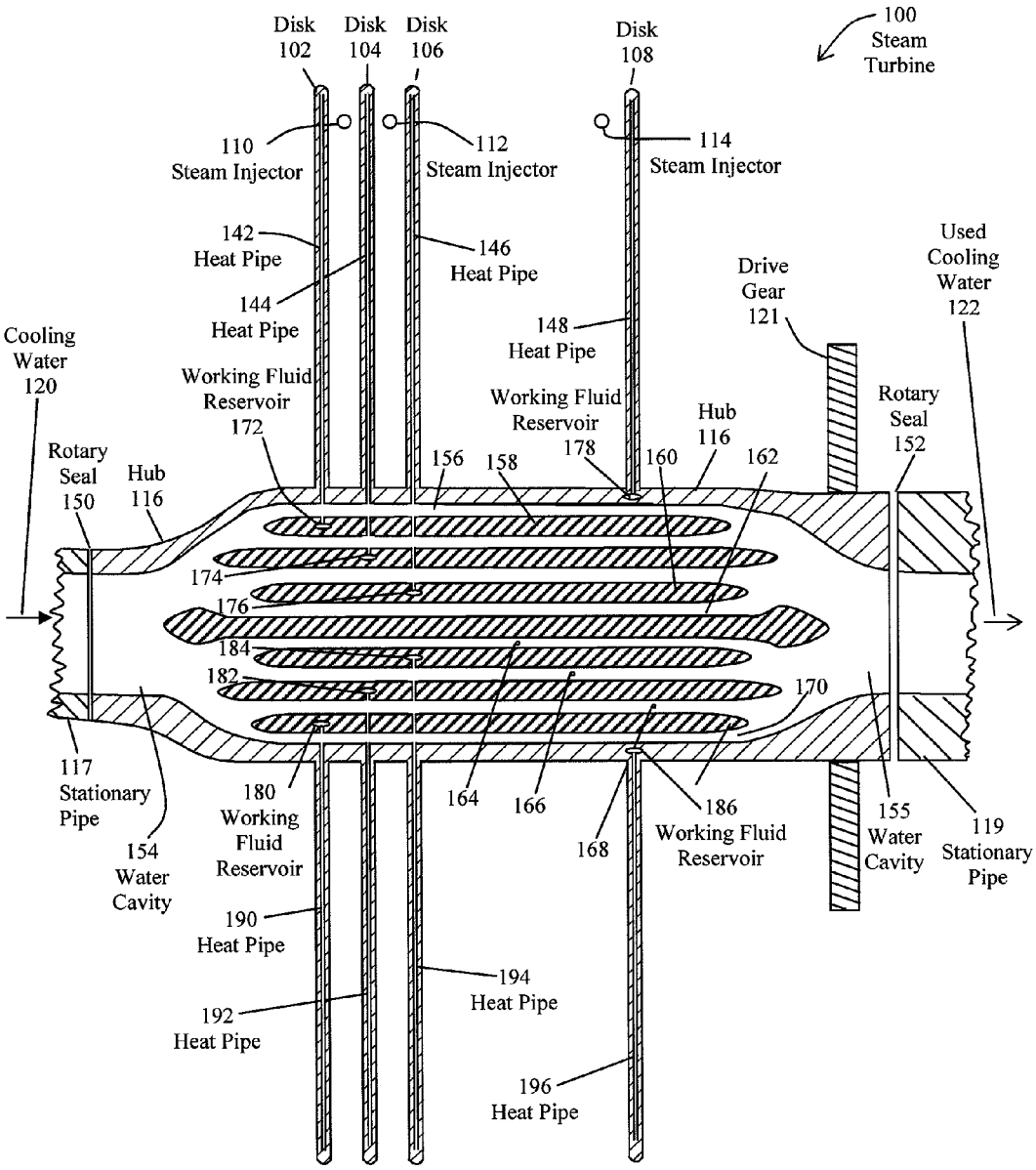
FIG. 3 is a side cutaway view of the steam turbine illustrated in FIG. 1.

FIG. 3 is a side cutaway view of the steam turbine system illustrated in FIG. 1. As illustrated in FIG. 3, cooling water 120 enters through a stationary pipe 117 and passes through a rotary seal 150, that provides a water-tight seal between the hub 116 and the stationary pipe 117. In this manner, the hub 116 can rotate while, at the same time, receiving a supply of the cooling water 120. The hub 116 has a plurality of water passages 156, 158, 160, 162, 164, 166, 168, 170 that are coupled to water cavity 154 to provide an increased surface area for cooling the hub 116. The water passages 156-170 are divided up so that water flows substantially evenly through the passages 156-170. Although FIG. 3 shows one method of providing the water flow, other methods can be used. The cooling water 120 exits the water passages 156-170 into water cavity 155 and travels through the hub 116 to the rotary seal 152. The rotary seal seals the hub 116 against stationary pipe 119. Used cooling water 122 then passes through stationary pipe 119 and exits the system. Drive gear 121 is coupled to the hub 116 to allow transfer of the rotational mechanical energy from the hub 116 to an external device.

As also shown in FIG. 3, the disks 102, 104, 106, 108 are thin, narrow disks that have a large diameter. The force created by the steam water molecules, as the steam water molecules condense on the surfaces of the disks 102-108, is very small. Hence, it is advantageous to inject the steam from the steam injectors 110, 112, 114 along the peripheral portions of the disks and to construct the disks so that the disks have a large diameter and low mass to generate more torque.

As also illustrated in FIG. 3, the heat pipes 142, 144, 146, 148 form a cavity at or near the central portion of the disks 102, 104, 106, 108 and extend from the outer peripheral portions of the disks 102-108 to the hub 116. Heat pipes 142, 144, 146, 148 are connected to reservoirs 172, 174, 176, 178 that are disposed within the hub 116 adjacent and proximate to the water passages 158, 160, 156, respectively. The heat pipes 190, 192, 194, 196, on the opposite sides of the disks 102-108, have reservoirs 180, 182, 184, 186 that are adjacent and proximate to water passages 168, 166, 164, 170, respectively. Of course, any arrangement of water passages and reservoirs can be used to provide cooling to the cool end of the heat pipes 142-148.

In operation, the working fluid in the heat pipes 142-148 condenses and cools in the hub 116, as a result of the flow of the cooling water 120 through the hub 116. The condensed fluid migrates to the outer hot ends of the heat pipes 142-148 as a result of centrifugal force of the rotating disks 102-108 where the working fluid vaporizes, or boils, and removes heat from the outer peripheral portions of the disks 102-108. The vapor of the working fluid then moves from the hot end 134 to the cool end 136 of the heat pipes 142-148, as a result of the gaseous pressure of the vapor of the working fluid. This process continues, so that heat is transferred from the peripheral portions of the disks 102-108 to the hub. In this manner, the heat deposited by the steam from the steam injectors 110, 112, 114 is removed by the cooling water 120, so that the outer peripheral portions of the disks 102-108 remain cool, which promotes the condensation of the steam molecules on the surfaces of the disk 102-108. Accordingly, the efficiency of the steam turbine system is increased since the steam molecules can more efficiently condense on the cooler surfaces of the disks 102-108.

Figure 4:
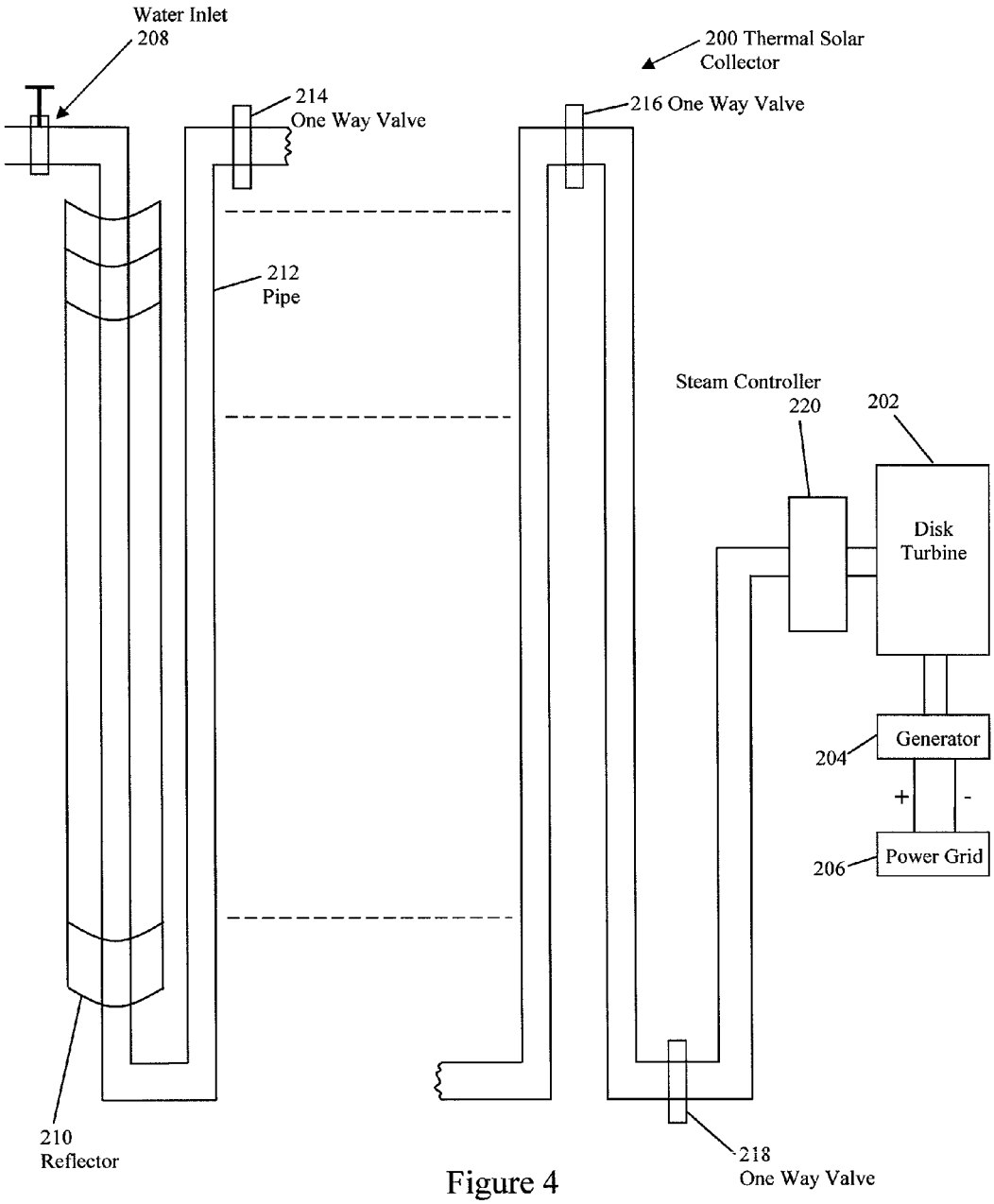
FIG. 4 is a schematic diagram of an embodiment of a thermal solar collector that is connected to a disk turbine.

FIG. 4 is a schematic diagram of an embodiment of a thermal solar collector 200 that is coupled to a disk turbine 202. Disk turbine 202 is mechanically connected to a generator 204, which generates electrical current that is applied to the power grid 206. The thermal solar collector 200, in the example illustrated in FIG. 4, comprises a matrix that is formed by a pipe 212 that covers a solar collection area. Of course, other thermal solar collectors can be used, such as a concentrated solar collector. Of course, costs are increased by the use of more complex solar collection systems. In that regard, a pipe 212 that is laid out in a serial matrix, such as illustrated in FIG. 4, or other pattern, over a solar collection area, is extremely inexpensive. The pipe may be painted black, or have a black surface layer, to better absorb solar energy. In addition, a stationary reflector, such as reflector 210, may be positioned below the pipe 212 to increase the solar collection area and focus solar rays onto the pipe 212. The reflector, although shown on a single length of the matrix, can be placed under all of the pipe 212 in the solar collection area. In addition, the reflector 210 can be movable to better reflect and focus the sun's rays on the pipe 212. Water inlet 208 allows water to flow through the pipe 212 and be heated by the sun's rays to create steam. A number of different water inlets may be used throughout the length of the pipe 212. A series of one-way valves 214, 216, 218 may function to build the pressure of the steam in the pipe 212 in each of the chambers. The one-way valves sequentially allow the steam to flow from one chamber to another. Each one-way valve may have a different pressure threshold for controlling the pressure at which the one-way valve opens. The one-way valves 214, 216, 218, and other valves, may be controlled by the steam controller 220. In that regard, the steam controller 220 can create a hybrid system in which additional heat energy can be added to the steam or heated water from the thermal solar collector by way of a gas burner, oil burner or other heat generating device. For example, low pressure steam, or simply water that is heated in the thermal solar collector 200, can be increased to temperature that creates steam using a fossil fuel burner or other heating device. In this manner, the thermal solar collector 200 adds an amount of energy to the water or other medium to increase the efficiency of the overall system and provide a hybrid system.

The disk turbine 202 may be any standard disk turbine, including a Tesla turbine, which does not have to include heat pipes for transferring energy. Further, the use of used cooling water 122, which has been heated to some extent, can be applied to water inlet 208, or other water inlets, in the pipe 212.

Figure 5:
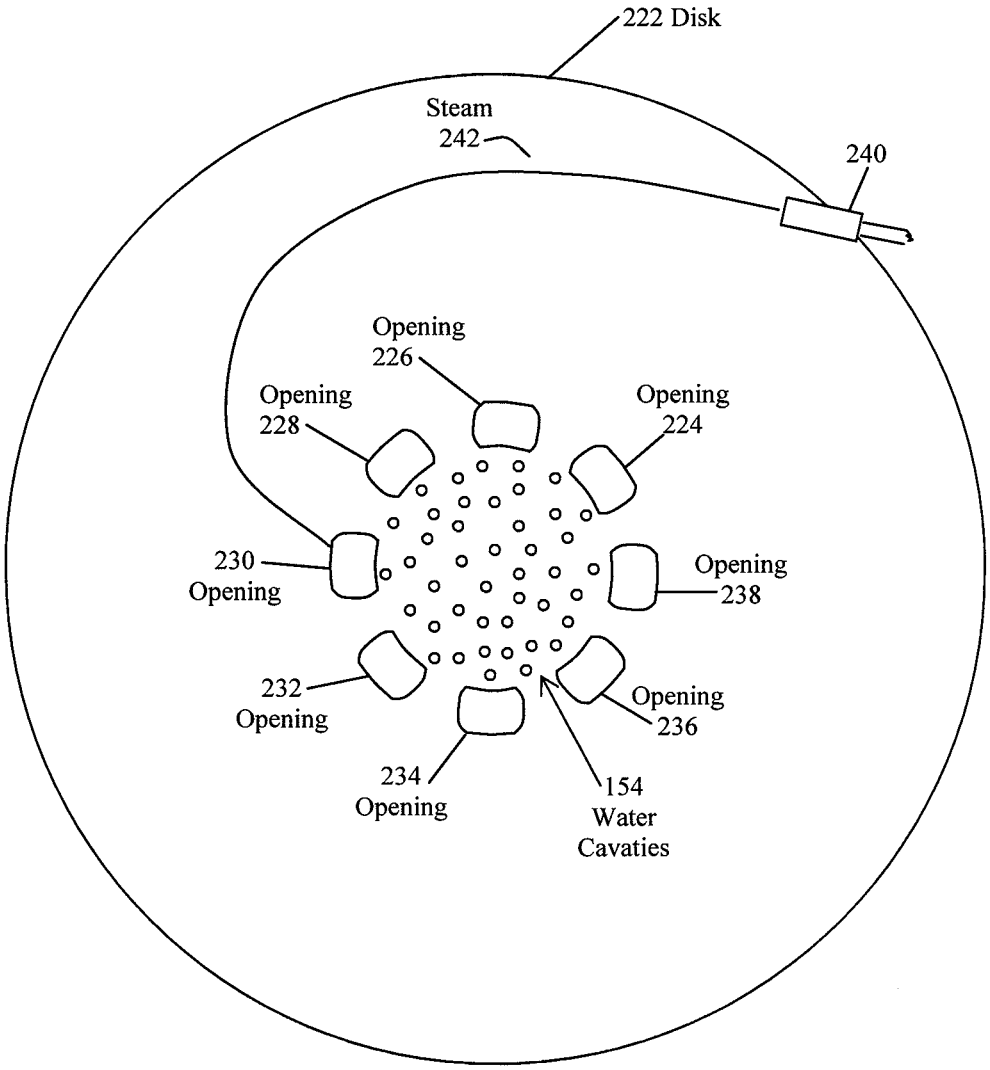
FIG. 5 is a schematic diagram of an embodiment of a disk for use in a disk turbine.

FIG. 5 is a schematic diagram of another embodiment of a disk 222 that may be used in a disk turbine. In accordance with the classic disk turbine, injected steam, such as steam 242 from an injector 240, is slowed by the boundary layer, and when sufficient drag is created, the steam 242 curves inwardly as a result of the Coriolis effect and is exhausted through a central exhaust manifold. As illustrated in FIG. 5, there are a series of openings 224, 226, 228, 230, 232, 234, 236, 238 that surround the central water cavities 154. The central water cavities provide cooling for the disks 222. The openings 224-238 provide an exhaust manifold for the steam 242 to exit the steam turbine 100. The openings 224-238 are formed in the hub 116 (FIG. 1) and provide an exhaust conduit for exhausting from the steam turbine 100 to either the atmosphere or another disk turbine to extract additional rotational mechanical energy.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A steam turbine comprising:

a plurality of disks that rotate on a hub, said disks being separated by a predetermined space;

steam injectors that inject steam between pairs of said disks in said predetermined space between said disks;

at least one heat pipe disposed in each of said disks that transfers heat from outer peripheral portions of said disks to said hub that is connected to said disks; and, cooling water that flows through said hub to remove said heat from said hub.

2. A method of removing heat from disks in a steam turbine comprising:

providing a plurality of disks that are spaced apart by a predetermined spacing;

injecting steam between said disks in said predetermined spacing, so that said steam condenses on said surfaces of said disks;

removing heat from said disks to a hub using heat pipes that are disposed in said disks; and, causing cooling water to flow through said hub to remove heat from a cool end of said heat pipes.

* * * * *